US010442219B2

(12) United States Patent
Ferrara, Jr. et al.

(10) Patent No.: US 10,442,219 B2
(45) Date of Patent: Oct. 15, 2019

(54) DUAL EDGE REGISTERED SHEETS TO MITIGATE PRINT HEAD JET DRY OUT ON SHORT SHEETS WITHIN INKJET CUT SHEET PRINTING

(71) Applicant: Xerox Corporation, Norwalk, CT (US)

(72) Inventors: Joseph M. Ferrara, Jr., Webster, NY (US); Stephen B. Williams, Marion, NY (US)

(73) Assignee: Xerox Corporation, Norwalk, CT (US)

( * ) Notice: Subject to any disclaimer, the term of this patent is extended or adjusted under 35 U.S.C. 154(b) by 83 days.

(21) Appl. No.: 15/872,020

(22) Filed: Jan. 16, 2018

(65) Prior Publication Data

US 2019/0217637 A1 Jul. 18, 2019

(51) Int. Cl.

| | |
|---|---|
| ***B41J 13/26*** | (2006.01) |
| ***B41J 2/045*** | (2006.01) |
| ***B41J 13/00*** | (2006.01) |
| ***B41J 13/03*** | (2006.01) |

(52) U.S. Cl.

CPC ..... *B41J 13/0027* (2013.01); *B41J 13/03* (2013.01); *B41J 13/26* (2013.01); *B41J 2/04505* (2013.01)

(58) Field of Classification Search

CPC ..... B41J 2/04573; B41J 2/04505; B41J 2/04551; B41J 2/04586; B41J 2/2132; B41J 2/2135; B41J 2/51; B41J 11/0055; B41J 11/005; B41J 11/04; B41J 11/44; B41J 12/01; B41J 11/42; B41J 11/46; B41J 13/0027; B41J 13/03; B41J 13/26

See application file for complete search history.

(56) References Cited

U.S. PATENT DOCUMENTS

| | | | |
|---|---|---|---|
| 4,786,045 | A | 11/1988 | Sam |
| 5,184,147 | A | 2/1993 | MacLane et al. |
| 5,760,801 | A | 6/1998 | Jackson et al. |
| 6,164,752 | A | 12/2000 | Schaefer et al. |
| 6,568,789 | B2 | 5/2003 | Lin et al. |
| 6,817,611 | B2 | 11/2004 | DiRamio |

(Continued)

OTHER PUBLICATIONS

Xerox Nuvera 100/120/144 MX Production System, Xerox Nuvera 200/288 MX Perfecting Production System, Xerox Corporation (2012) 8 pages.

(Continued)

*Primary Examiner* — Thinh H Nguyen

(74) *Attorney, Agent, or Firm* — Loza & Loza LLP; Kermit D. Lopez; Luis M. Ortiz

(57) ABSTRACT

Systems, methods, and devices for mitigating print head dry out. In an example embodiment, a system can be implemented, which includes an arrangement of cross rollers and a registration transport for transporting one or more sheets for printing, and a steering mechanism that drives the sheet(s) into the opposing registration print edges of print heads on the registration transportation, wherein the cross rollers only engage when the sheet is being registered to the appropriate edge of the print heads, thereby allowing the print heads to be exercised prior to drying out. When one or more of the sheets are out of the nip, the nip disengages, thereby allowing the next sheet to be stirred on the opposing edge of the registration print heads. The opposing registration print heads comprise an inboard registration edge and an outboard registration edge.

20 Claims, 5 Drawing Sheets

(56) References Cited

U.S. PATENT DOCUMENTS

| | | | | |
|---|---|---|---|---|
| 6,991,312 | B2 | 1/2006 | Uwagaki et al. | |
| 7,264,328 | B2 | 9/2007 | Folkins et al. | |
| 7,300,133 | B1 | 11/2007 | Folkins et al. | |
| 7,901,029 | B2 | 3/2011 | Baker | |
| 8,172,359 | B2 | 5/2012 | Askeland et al. | |
| 8,206,048 | B2 * | 6/2012 | Ferrara | B65H 9/002 400/578 |
| 9,227,429 | B1 | 1/2016 | LeStrange et al. | |
| 9,403,383 | B1 | 8/2016 | Liu et al. | |
| 9,452,607 | B2 | 9/2016 | Kuypers et al. | |
| 9,604,471 | B2 | 3/2017 | Liu | |
| 9,610,764 | B2 | 4/2017 | Thayer et al. | |
| 2014/0168304 | A1 | 6/2014 | Mizes et al. | |
| 2014/0168312 | A1 | 6/2014 | Mizes et al. | |
| 2016/0159084 | A1 | 6/2016 | Liu | |
| 2016/0167381 | A1 | 6/2016 | Thayer et al. | |
| 2016/0332447 | A1 | 11/2016 | Condello et al. | |
| 2017/0008311 | A1 | 6/2017 | Liu | |
| 2017/0239957 | A1 | 8/2017 | Ochs | |

OTHER PUBLICATIONS

Printing Lingo: What does Registration mean?, Formax Printing, printed Nov. 29, 2017, 4 pages.

Xerox Brenva HD Production Inkjet Press, Xerox Corporation (2016) 11 pages.

* cited by examiner

DUAL EDGE REGISTERED SHEETS TO MITIGATE PRINT HEAD JET DRY OUT ON SHORT SHEETS WITHIN INKJET CUT SHEET PRINTING

TECHNICAL FIELD

Embodiments are generally related to inkjet printers. Embodiments additionally relate to aqueous inkjet printers. Embodiments further relate to devices, systems, and techniques for mitigating drying out of inkjet print heads used in aqueous inkjet printers.

BACKGROUND

In general, inkjet printing machines or printers can include one or more print heads that eject drops or jets of liquid ink onto a recording or image-forming surface. An aqueous inkjet printer employs water-based or solvent-based inks in which pigments or other colorants are suspended or in solution. Once the aqueous ink is ejected onto an image-receiving surface by a print head, the water or solvent is evaporated to stabilize the ink image on the image-receiving surface.

In most aqueous inkjet printers, varying sheet sizes can be employed while printing jobs. The maximum print zone for conventional aqueous inkjet printers is generally a result of the maximum width of a paper path or the maximum width of the print head array. When a customer prints a legal size documents having a long edge feed, with a relatively full image, all jets on the print heads will be consumed. If a customer, however, uses a smaller size or a short edge feed, one or more jets may not see any ink movement for a particularly long period, dependent on the length of the job being printed. As a result, these jets can develop viscous fluid that blocks the jets, causing missing jets if the next job requires these particular jets. To mitigate these problems, a customer or a user will need to run a print head maintenance operation to purge ink from the heads—which is a waste of consumables as well as a productivity hit.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for improved methods and systems are disclosed for mitigating print head dry out.

It is another aspect of the disclosed embodiments to provide for a method and system that includes the use of dual edge registered sheets to mitigate jet dry out on short sheets within inject cut sheet printing.

It is yet another aspect of the disclosed embodiments to provide for a steering mechanism that drives sheets into opposing registration edges in an aqueous ink jet printer.

The aforementioned aspects and other objectives and advantages can now be achieved as described herein. Methods and systems are disclosed for mitigating print head dry out. In an example embodiment, a system can be implemented, which includes an arrangement of cross rollers and a registration transport for transporting one or more sheets for printing, and a steering mechanism that drives the sheet(s) into the opposing registration print edges of print heads on the registration transportation, wherein the cross rollers only engage when the sheet is being registered to the appropriate edge of the print heads, thereby allowing the print heads to be exercised prior to drying out. When one or more of the sheets are out of the nip, the nip disengages, thereby allowing the next sheet to be stirred on the opposing edge of the registration print heads. The opposing registration print heads comprise an inboard registration edge and an outboard registration edge.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
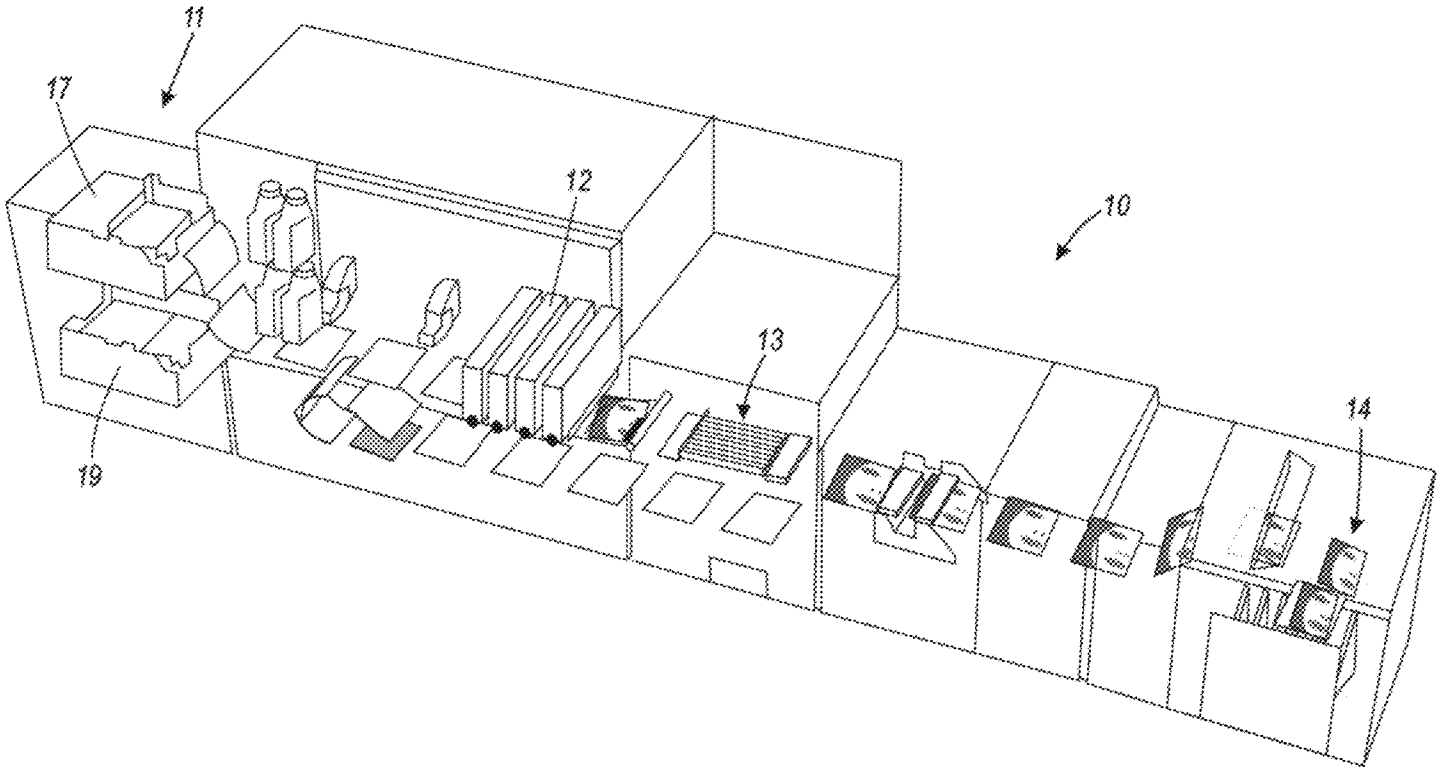
FIG. 1 illustrates a schematic diagram of an aqueous inkjet printer, which may be implemented in accordance with an example embodiment.

The particular values and configurations discussed in these non-limiting examples can be varied and are cited merely to illustrate one or more embodiments and are not intended to limit the scope thereof.

Subject matter will now be described more fully herein after with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems/devices. Accordingly, embodiments may, for example, take the form of hardware, software, firmware, or any combination thereof (other than software per se). The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein do not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. Additionally, the term "step" can be utilized interchangeably with "instruction" or "operation.".

For a general understanding of the disclosed example embodiments, reference is made to the drawings. In the drawings, like reference numerals have been used throughout to designate like elements. As used herein, the terms "printer," "printing device," "imaging device," or "rendering device" generally refer to a device that produces an image on print media with aqueous ink and may encompass any such apparatus, such as a digital copier, bookmaking machine, facsimile machine, multi-function machine, or the like, which generates printed images for any purpose. Image data generally includes information in electronic form, which are rendered and used to operate the inkjet ejectors to form an ink image on the print media. This data can include text, graphics, pictures, and the like. The operation of producing images with colorants on print media, for example, graphics, text, photographs, and the like, is generally referred to herein as printing or marking. Aqueous inkjet printers use inks that have a high percentage of water relative to the amount of colorant in the ink.

The term "printhead" or "print head" as used herein refers to a component in the printer that is configured with inkjet ejectors to eject ink drops onto an image-receiving surface. A typical printhead includes a plurality of inkjet ejectors that eject ink drops of one or more ink colors onto the image-receiving surface in response to firing signals that operate actuators in the inkjet ejectors. The inkjets are arranged in an array of one or more rows and columns. In some example embodiments, the inkjets are arranged in staggered diagonal rows across a face of the printhead. Various printer embodiments include one or more print heads that form ink images on an image-receiving surface. Some printer embodiments include a plurality of print heads arranged in a print zone. An image-receiving surface, such as an intermediate imaging surface, moves past the print heads in a process direction through the print zone. The inkjets in the print heads eject ink drops in rows in a cross-process direction, which is perpendicular to the process direction across the image-receiving surface. As used in this document, the term "aqueous ink" includes liquid inks in which colorant is in solution with water or one or more solvents.

FIG. 1 illustrates a schematic diagram of an aqueous inkjet printer 10, which may be implemented in accordance with an example embodiment. The aqueous inkjet printer 10 shown in FIG. 1 generally includes a number of sections or modules, such as, for example, a sheet feed module 11 that includes an upper tray 17 and a lower tray 19 that can each contain media such as paper, a print head and ink assembly module 12, a dryer module 13, and a production stacker 14. Such modules can be composed of physical hardware components, but in some cases may include the use of software or maybe subject to software instructions.

It should be appreciated that the aqueous inkjet printer 10 depicted in FIG. 1 represents one example of an aqueous inkjet printer that can be adapted for use with one or more example embodiments. The particular configuration shown in FIG. 1 should not be considered a limiting feature of the disclosed embodiments. That is, other types of inkjet printers can be implemented in accordance with varying embodiments. The example aqueous inkjet printer 10 depicted in FIG. 1 can be configured as a printer that uses water-based inks or solvent-based inks.

The sheet feed module 11 of the aqueous inkjet printer 10 can hold, for example, 2,500 sheets of 90 gsm, 4.0 caliper stock in each of two trays. With 5,000 sheets per unit and up to 4 possible feeders in your configuration, 20,000 sheets of non-stop productivity can be provided. The sheet feed module can include an upper tray 17 that holds, for example, paper sizes 8.27"×10"/210 mm×254 mm to 14.33"×20.5"/364 mm×521 mm, while a lower tray 19 can hold paper sizes ranging from 7"×10"/178 mm×254 mm to 14.33"×20.5"/364 mm×521 mm. Each feeder can utilize a shuttle vacuum feed head to pick a sheet off the top of the stack and deliver it to a transport mechanism.

The print head and ink assembly module 12 of the aqueous inkjet printer 10 can include, for example, a plurality of inkjet print heads that deliver four different drop sizes through, for example, 7,870 nozzles per color to produce prints with, for example, a 600×600 dpi. An integrated full-width scanner can enable automated print head adjustments, missing jet correction, and image-on-paper registration. Operators can make image quality improvements for special jobs such as edge enhancement, trapping, and black overprint. At all times automated checks and preventative measures can maintain the press in a ready state and operational.

The dryer module 13 of the aqueous inkjet printer 10 includes a dryer. After printing, the sheets move directly into a dryer where the paper and ink are heated with seven infrared carbon lamps to about 90° C. (194° F.). This process removes moisture from the paper so the sheets are stiff enough to move efficiently through the paper path. The drying process also removes moisture from the ink to prevent it from rubbing off. A combination of sensors, thermostats, thermistors, thermopiles, and blowers accurately heat these fast-moving sheets and maintain rated print speed.

The production stacker 14 includes a finisher that can run continuously as it delivers up to 2,850 sheets at a time. Once unloaded, the stack tray returns to the main stack cavity to pick and deliver another load—continuously. The stacker 14 can provide an adjustable waist-height for unloading from, for example, 8" to 24", and a by-pass path with the ability to rotate sheets to downstream devices. The production stacker 14 can also be configured with, for example, a 250-sheet top tray for sheet purge and samples, and can further include an optional production media cart to ease stack transport.

Figure 2:
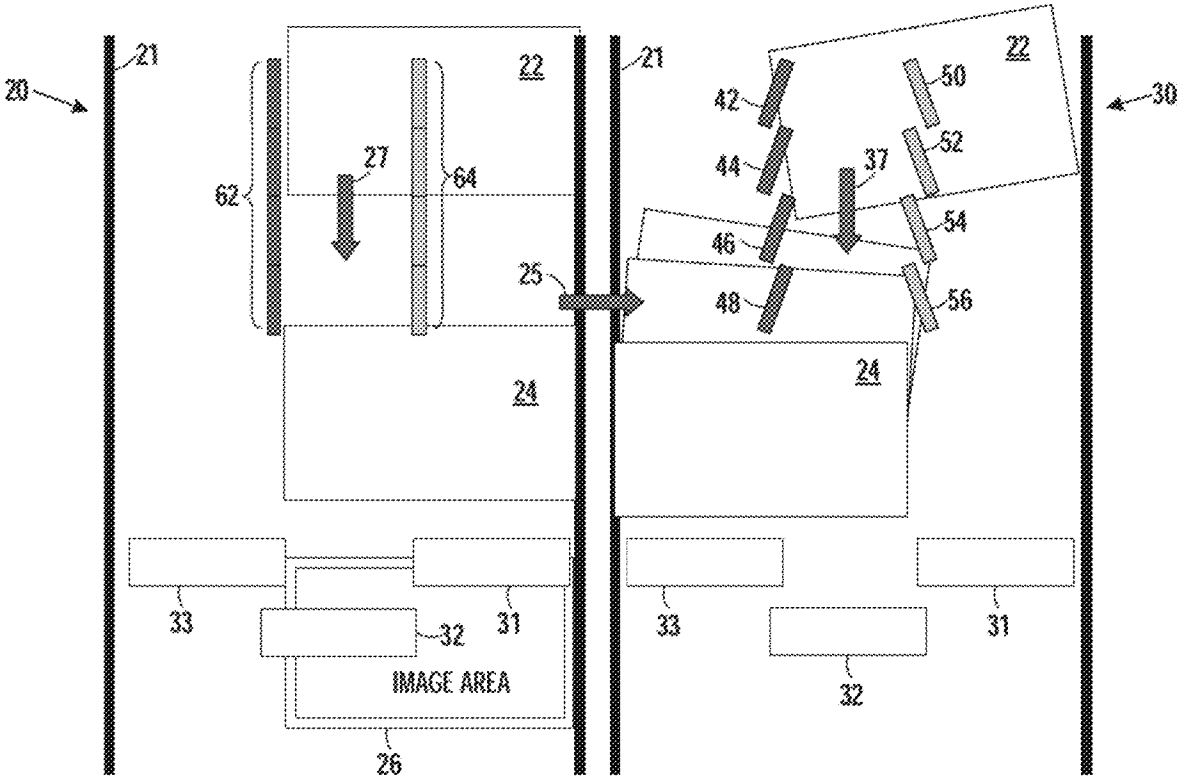
FIG. 2 illustrates a system that includes the use of dual edge registered sheets for mitigating print head jet dry out on short sheets within ink jet cut sheet printing in an aqueous inkjet printer such as the printer shown in FIG. 1, in accordance with an example embodiment.

FIG. 2 illustrates a system 30 that includes the use of dual edge registered sheets for mitigating print head jet dry out on short sheets within ink jet cut sheet printing in an aqueous inkjet printer such as the printer 10 shown in FIG. 1, in accordance with an example embodiment. The system 30 is shown at the right hand side of FIG. 2 in comparison to a conventional system 20. Note that in systems 20 and 30, similar or identical parts are indicated by similar or identical reference numerals.

As discussed previously, dual edge registration can be utilized in the context of a method for avoiding drying out of aqueous print heads on small jobs. Thus, if a customer prints an 11" wide image, the third print heads jets that are not used typically dry and require purging and may require more assistance when switching to a full width job (e.g., 14").

This approach is shown at the right hand side (i.e., system 20) of FIG. 2. In general, as shown in the approach of system 20, one or more substrates or sheets such as sheet 22 and 24 move in a direction or path indicated by arrow 27 along a registration transport 21. A nip mechanism is provided that includes nip rollers 62 and 64 that extend parallel to each other and directly oppose each other. Such rollers are used to move substrates or sheets such as sheet 22 and 24 along the registration transport 21. In one typical mode of operation, the nip rollers are initially separated from each other, i.e., open, and a substrate such as sheet 22 is inserted between the nip rollers. The nip rollers are then brought together, i.e., closed, to engage the substrate between the two nip rollers. One or both of the nip rollers are then driven to transfer the substrate. Engaged and disengaged cross rollers are thus shown generally parallel to the arrow 27 as indicated by rollers 62 and 64. For example, line 62 shows a configuration of Engaged, Disengaged, Engaged and Engaged. Line 64 shows a similar configuration.

A plurality of print heads including a first print head 31, a second print head 32, and a third print head 33 are shown with respect to an imaged area 26. The configuration of system 30 shown at the right hand side of FIG. 2 involves a method of alternating to opposing edges on the registration transport and utilizes cross rollers that only engage when the sheet 22 is being registered to the appropriate registration edge. Such cross rollers include, for example, cross rollers 42, 44, 46, 48, and 50, 52, 54, 56, some of which are shown as engaged and some of which are shown as disengaged. When the sheet 22 is out of the nip, the nip will disengage, allowing the next sheet to be stirred into the opposing edge. Additional nips may be necessary to accommodate smaller paper sizes, as well as more vigorous stirring. The arrow 25 shown in FIG. 2 is used to demonstrate the contrast between the different approaches of system 20 and system 30.

Note that the term "registration" or "register" as utilized here relates to the precision alignment and placement of substrates such as sheet 22. Proper registration means that any impression on the substrate, sheet or paper—ink, metallic foil, embossing, die cut shape, etc.—occurs in the precise position as intended. Conversely, the register is said to be "off" if any element of the print job is misaligned or displaced. The registration of printed substrates is affected not only by the initial settings on the production equipment, but also by any movement of the sheet, substrate, or paper as it runs through the equipment.

The approach of system 30 thus implements a steering mechanism that can drive sheets such as sheet 22 into opposing registration edges. By alternating edges every "x" sheets, this approach assists in exercising the jets more evenly on the heads, minimizing drying out of the jets. This approach can also provide for greater longevity to a customer's print head for the fact that in conventional printers, on a full area coverage job, head 1 (e.g., print head 31) will always be printing, for any size job, while print head 3 (e.g., print head 33) may not, in feed lengths of, for example, 7"-8". This approach can result in less consumable replacements by a customer/user.

Figure 3:
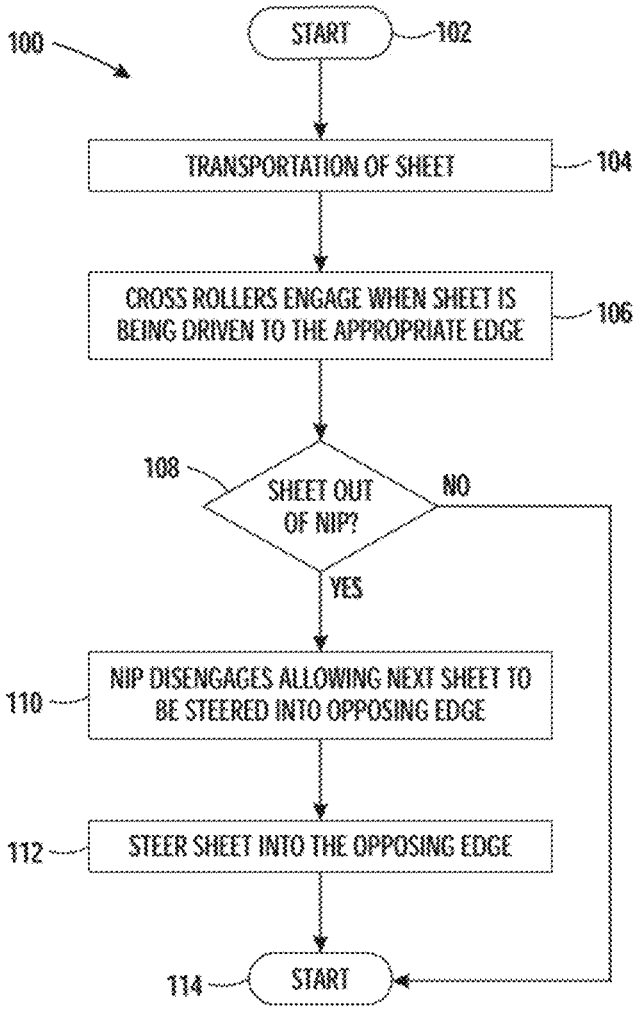
FIG. 3 illustrates a flow chart of operations depicting logical operational steps of a method for alternating to opposing edges on a registration transport, in accordance with an example embodiment.

FIG. 3 illustrates a flow chart of operations depicting logical operational steps of a method 100 for alternating to opposing edges on a registration transport, in accordance with an example embodiment. As shown at block 102, the process begins. Next, as shown at block 104, an operation can be implemented for transporting one or more sheets/substrates (e.g., paper) on a registration transport. Thereafter, as shown at block 106, the cross rollers can engage when the sheet is being driven to the appropriate edge. Next, as depicted at decision block 108, a test or operation can be implemented to determine if the sheet is out of the nip. If so, then as shown at block 110, the nip disengages, thereby allowing the next sheet to be steered into the opposing edge. Thereafter, as indicated at block 112, the sheet is actually steered to the opposing edge. The process then ends, as shown at block 114. Note that in some example embodiments, additional nips may be necessary to accommodate smaller paper sizes, as well as more vigorous steering. Note that the method 100 shown in FIG. 3 can be implemented with "x" amount of sheets. For example, after every 10 sheets, a pitch may be skipped, and then the next 10 sheets can be steered to the other registration edge.

Figure 4:
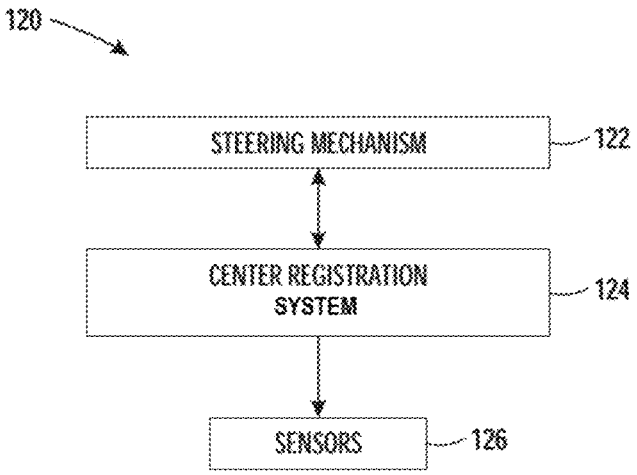
FIG. 4 illustrates a block diagram of a system for alternating to opposing edges on a registration transport, in accordance with an alternative example embodiment.

FIG. 4 illustrates a block diagram of a system 120 for alternating to opposing edges on a registration transport, in accordance with an alternative example embodiment. The configuration shown in FIG. 4 represents an alternative to the roller based configurations described herein. That is, a center registration system 124 can be implemented in the context of an aqueous ink jet print to steer sheets rather than the cross rollers discussed with respect to the other example embodiments. The center registration system 124 can communicate with or can be configured with additional sensors 126 that allow for incremental steer in the sheets 122, progressively moving such sheets over the full jet array of all print heads. Using this approach can results in increased productivity performance over the cross rolls because the transition in sheets moving from one side to the next will be more gradual and better monitored for image processing, allowing for precise pixel to jet mapping onto the sheets as they are steered.

As can be appreciated by one skilled in the art, embodiments can be implemented in the context of a method, data processing system, or computer program product. Accordingly, embodiments may take the form of an entire hardware embodiment, an entire software embodiment, or an embodiment combining software and hardware aspects all generally referred to herein as a "circuit" or "module." Furthermore, embodiments may in some cases take the form of a computer program product on a computer-usable storage medium having computer-usable program code embodied in the medium. Any suitable computer readable medium may be utilized including hard disks, USB Flash Drives, DVDs, CD-ROMs, optical storage devices, magnetic storage devices, server storage, databases, etc.

Computer program code for carrying out operations of the present invention may be written in an object-oriented programming language (e.g., Java, C++, etc.). The computer program code, however, for carrying out operations of particular embodiments may also be written in conventional procedural programming languages, such as the "C" programming language or in a visually oriented programming environment, such as, for example, Visual Basic.

The program code may execute entirely on the user's computer, partly on the user's computer, as a stand-alone software package, partly on the user's computer and partly on a remote computer, or entirely on the remote computer. In the latter scenario, the remote computer may be connected to a user's computer through a local area network (LAN) or a wide area network (WAN), wireless data network e.g., Wi-Fi, Wimax, 802.xx, and cellular network, or the connection may be made to an external computer via most third party supported networks (for example, through the Internet utilizing an Internet Service Provider).

The embodiments are described at least in part herein with reference to flowchart illustrations and/or block diagrams of methods, systems, and computer program products and data structures according to embodiments of the invention. It will be understood that each block of the illustrations, and combinations of blocks, can be implemented by computer program instructions. These computer program instructions may be provided to a processor of, for example, a general-purpose computer, special-purpose computer, or other programmable data processing apparatus to produce a machine, such that the instructions, which execute via the processor of the computer or other programmable data processing apparatus, create means for implementing the functions/acts specified in the block or blocks. To be clear, however, the disclosed embodiments can be implemented in the context of, for example, a special-purpose computer or a general-purpose computer, or other programmable data processing apparatus or system. For example, in some embodiments, a data processing apparatus or system can be implemented as a combination of a special-purpose computer and a general-purpose computer. In some example embodiments, the data processing system apparatus discussed herein can be implemented as a special-purpose computer. A printing system thus may be a special-purpose computer in some cases.

The computer program instructions discussed herein may also be stored in a computer-readable memory that can direct a computer or other programmable data processing apparatus to function in a particular manner, such that the instructions stored in the computer-readable memory produce an article of manufacture including instruction means which implement the function/act specified in the various block or blocks, flowcharts, and other architecture illustrated and described herein. Such instructions can, for example, include instructions (i.e., steps or operations) such as those depicted in FIG. 3 with respect to blocks 102 to 114.

Note that a processor (also referred to as a "processing device") may perform or otherwise carry out any of the operational steps, processing steps, computational steps, method steps, or other functionality disclosed herein, including analysis, manipulation, conversion or creation of data, or other operations on data. A processor may include a general-purpose processor, a digital signal processor (DSP), an integrated circuit, a server, other programmable logic device, or any combination thereof. A processor may be a conventional processor, microprocessor, controller, microcontroller, or state machine. A processor can also refer to a chip or part of a chip (e.g., semiconductor chip). The term "processor" may refer to one, two, or more processors of the same or different types. It is noted that a computer, computing device and user device, and the like, may refer to devices that include a processor, or may be equivalent to the processor itself.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 5:
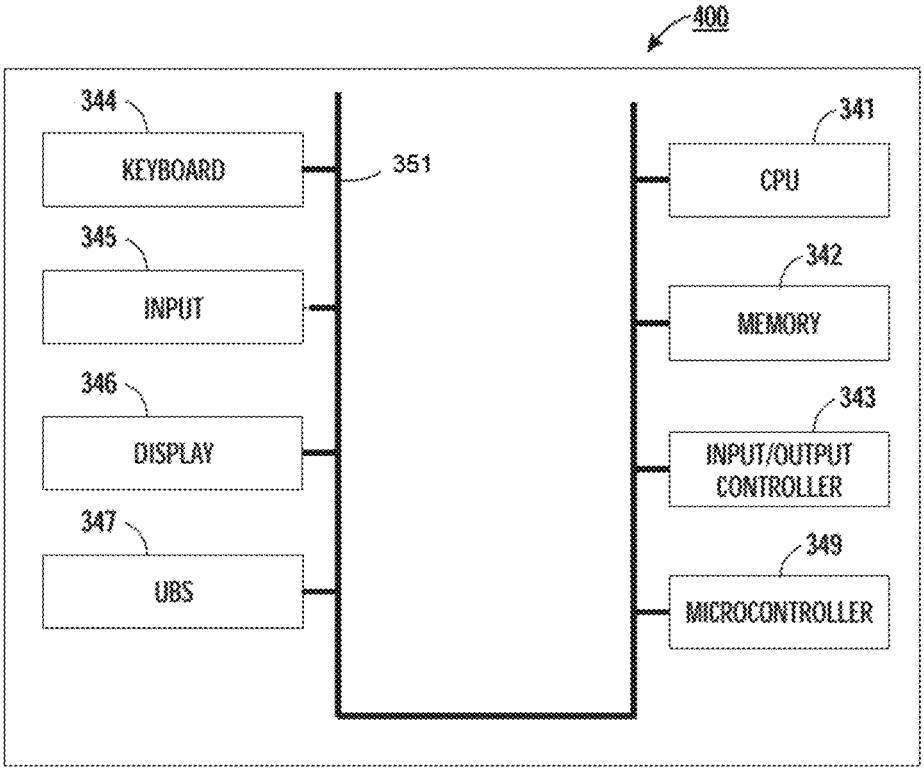
FIG. 5 illustrates a schematic view of a computer system/apparatus, which can be adapted for use in accordance with an example embodiment.
Figure 6:
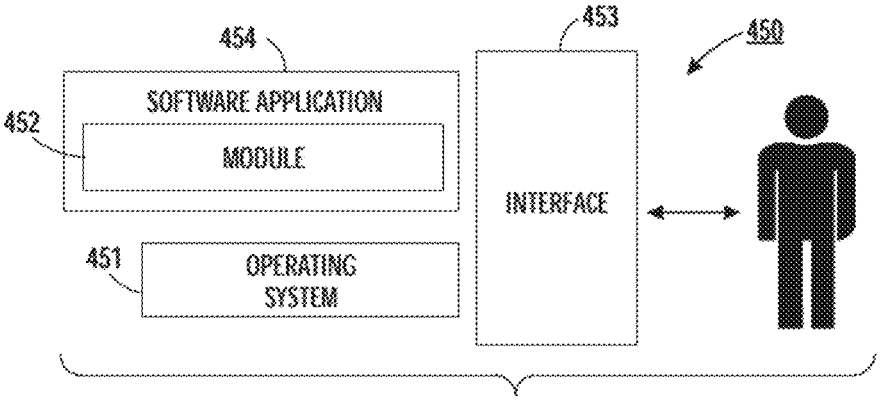
FIG. 6 illustrates a schematic view of a software system including a module, an operating system, and a user interface, which can also be adapted for use in accordance with an example embodiment.

FIGS. 5-6 are shown only as exemplary diagrams of data-processing environments in which example embodiments may be implemented. It should be appreciated that FIGS. 5-6 are only exemplary and are not intended to assert or imply any limitation with regard to the environments in which aspects or embodiments of the disclosed embodiments may be implemented. Many modifications to the depicted environments may be made without departing from the spirit and scope of the disclosed embodiments.

As illustrated in FIG. 5, some embodiments may be implemented in the context of a data-processing system/apparatus 400 that can include, for example, one or more processors such as a processor 341 (e.g., a CPU (Central Processing Unit) and/or other microprocessors), a memory 342, an input/output controller 343, a microcontroller 349 (which may be optional), a peripheral USB (Universal Serial Bus) connection 347, a keyboard 344 and/or another input device 345 (e.g., a pointing device, such as a mouse, track ball, pen device, etc.), a display 346 (e.g., a monitor, touch screen display, etc) and/or other peripheral connections and components. In some example embodiments, the peripheral USB (Universal Serial Bus) connection 347 maybe connected electronically to a printing device or a system such as the printer 10 shown in FIG. 1.

As illustrated, the various components of data-processing system/apparatus 400 can communicate electronically through a system bus 351 or similar architecture. The system bus 351 may be, for example, a subsystem that transfers data between, for example, computer components within data-processing system/apparatus 400 or to and from other data-processing devices, components, computers, etc. The data-processing system/apparatus 400 may be implemented in some embodiments as, for example, a server in a client-server based network (e.g., the Internet) or in the context of a client and a server (i.e., where aspects are practiced on the client and the server).

In some example embodiments, data-processing system/apparatus 400 may be, for example, a standalone desktop computer, a laptop computer, a Smartphone, a pad computing device and so on, wherein each such device is operably connected to and/or in communication with a client-server based network or other types of networks (e.g., cellular networks, Wi-Fi, etc.). In other example embodiments, the data-processing system/apparatus 400 may be integrated with a printing system or device, such as, for example, the printer 10 discussed previously herein or other types of imaging or printing devices and systems, to control the operations of such a printing device or system. In still other example embodiments, the data-processing system/apparatus 400 may communicate wirelessly with a printing device or system such as printer 10 of FIG. 1 through a bidirectional packet-based wireless communications network (e.g., cellular networks, Wi-Fi, etc.).

FIG. 6 illustrates a computer software system/apparatus 450 for directing the operation of the data-processing system/apparatus 400 depicted in FIG. 5. The computer software system/apparatus 450 includes a software application 454, an OS (Operating System) 451, and a shell or interface 453. The software application 454 can include a module 452 and can be stored in, for example, memory 342 shown in FIG. 5. The computer software system/apparatus 450 generally includes the kernel or OS 451 and the shell or interface 453. The OS 451 can be implemented in the context of system software that manages computer hardware and software resources and provides common services for computer programs.

One or more application programs, such as software application 454, may be "loaded" (i.e., transferred from, for example, mass storage or another memory location into the memory 342) for execution by the data-processing system/apparatus 400. The data-processing system/apparatus 400 can receive user commands and data through the interface 453; these inputs may then be acted upon by the data-processing system/apparatus 400 in accordance with instructions from operating system 451 and/or software application 454. The interface 453 in some embodiments can serve to display results, whereupon a user may supply additional inputs or terminate a session. The software application 454 can include module(s) 452, which can, for example, implement the various instructions or operations such as those discussed herein with respect to FIGS. 1-4 herein. Module 452 may also be composed of a group of modules or sub-modules that implement particular modules, such as, for example, the various modules (and components/features, etc.) or components and operations discussed and illustrated herein with respect to FIGS. 1-4.

The following discussion is intended to provide a brief, general description of suitable computing environments in which the system and method may be implemented. Although not required, the disclosed embodiments will be described in the general context of computer-executable instructions, such as program modules, being executed by a single computer. In most instances, a "module" can constitute a software application, but can also be implemented as both software and hardware (i.e., a combination of software and hardware).

Generally, program modules include, but are not limited to, routines, subroutines, software applications, programs, objects, components, data structures, etc., that perform particular tasks or implement particular data types and instructions. Moreover, those skilled in the art will appreciate that the disclosed method and system may be practiced with other computer system configurations, such as, for example, hand-held devices, multi-processor systems, data networks, microprocessor-based or programmable consumer electronics, networked PCs, minicomputers, mainframe computers, servers, and the like.

Note that the term module as utilized herein may refer to a collection of routines and data structures that perform a particular task or implements a particular data type. Modules may be composed of two parts: an interface, which lists the constants, data types, variable, and routines that can be accessed by other modules or routines; and an implementation, which is typically private (accessible only to that module) and which includes source code that actually implements the routines in the module. The term module may also simply refer to an application, such as a computer program designed to assist in the performance of a specific task, such as word processing, accounting, inventory management, etc. In other embodiments, a module may refer to a hardware component or a combination of hardware and software.

FIGS. 5-6 are thus intended as examples and not as architectural limitations of the disclosed embodiments. Additionally, such example embodiments are not limited to any particular application or computing or data processing environment. Instead, those skilled in the art will appreciate that the disclosed approach may be advantageously applied to a variety of systems and application software. Moreover, the disclosed embodiments can be embodied on a variety of different computing platforms, such as but not limited to Macintosh, Windows, Android, UNIX, LINUX, and so on.

Based on the foregoing, it can be appreciated that a number of embodiments, alternative and preferred, are disclosed herein. For example, in a preferred embodiment, a system for mitigating print head dry out can be implemented. Such a system can include, for example, an arrangement of cross rollers and a registration transport for transporting one or more substrates for printing; and a steering mechanism that drives the substrate or substrates into opposing registration print edges of print heads on the registration transportation. The cross rollers only engage when the substrate(s) is being registered to an appropriate edge of the print heads, thereby allowing the print heads to be exercised prior to drying out.

In some example embodiments, when the substrate(s) is out of at least one nip, the nip (or nips) disengages, thereby allowing at least one next sheet to be stirred on an opposing edge of the registration print heads. In some example embodiments, the opposing registration print heads can constitute an inboard registration edge and an outboard registration edge.

In still another example embodiment, the aforementioned arrangement of cross rollers can include a first series of cross rollers deployed opposite a second series of cross rollers wherein at least some cross rollers among the first the series of cross rollers are disengaged and engaged during transport of the at least one substrate, and wherein at least some of cross rollers among the second series of cross rollers are disengaged and engaged during the transport of the sheet.

In yet another example embodiment, a nip mechanism can be implemented, which includes a plurality of nip rollers that extend parallel to each other and direction in opposition to one another, wherein the arrangement of cross rollers comprises the plurality of nip rollers, wherein the plurality of nip rollers move the substrate(s) along the registration transport.

In some example embodiments, the aforementioned substrate(s) can be, for example, a sheet, paper, metal, foil, a die cut material, and so on.

In some example embodiments, a printer apparatus for printing can be implemented, which includes the aforementioned arrangement of cross rollers and the registration transport and the steering mechanism. In some example embodiments, the printer apparatus can be an aqueous inkjet printer.

In another example embodiment, a system for mitigating print head dry out can be implemented, which includes one or more processors, and a non-transitory computer-usable medium embodying computer program code, the computer-usable medium capable of communicating with the processor or processors. The computer program code can include instructions executable by the processor(s) and configured for: transporting one or more substrates for printing utilizing an arrangement of cross rollers and a registration transport; and driving the substrate or substrates into opposing registration print edges of print heads on the registration transportation via a steering mechanism, such that the cross rollers only engage when the substrate(s) is being registered to an appropriate edge of the print heads, thereby allowing the print heads to be exercised prior to drying out.

In yet another example embodiment, a method for mitigating print head dry out can be implemented in the context of a printer apparatus, which includes, for example, steps, instructions, or operations such as: automatically transporting one or more substrates for printing utilizing an arrangement of cross rollers and a registration transport; and automatically driving the substrate(s) into opposing registration print edges of print heads on the registration transportation via a steering mechanism, such that the cross rollers only engage when the substrate(s) is being registered to an appropriate edge of the print heads, thereby allowing the print heads to be exercised prior to drying out.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A system for mitigating print head dry out, comprising:

an arrangement of cross rollers and a registration transport for transporting at least one substrate for printing; and a steering mechanism that drives said at least one substrate into opposing registration print edges of print heads on said registration transportation, wherein said cross rollers only engage when said at least one substrate is being registered to an appropriate edge of said print heads, thereby allowing said print heads to be exercised prior to drying out.

2. The system of claim 1 wherein when said at least one substrate is out of at least one nip, said at least one nip disengages, thereby allowing at least one next sheet to be stirred on an opposing edge of said registration print heads.

3. The system of claim 1 wherein said opposing registration print heads comprise an inboard registration edge and an outboard registration edge.

4. The system of claim 1 wherein said arrangement of cross rollers comprises a first series of cross rollers deployed opposite a second series of cross rollers wherein at least some cross rollers among said first said series of cross rollers are disengaged and engaged during transport of said at least one substrate, and wherein at least some of cross rollers among said second series of cross rollers are disengaged and engaged during said transport of said sheet.

5. The system of claim 1 further comprising:

a nip mechanism that includes a plurality of nip rollers that extend parallel to each other and direction in opposition to one another, wherein said arrangement of cross rollers comprises said plurality of nip rollers, wherein said plurality of nip rollers move said at least one substrate along said registration transport.

6. The system of claim 1 wherein said at least one substrate comprises at least one sheet.

7. The system of claim 1 wherein said at least one substrate comprises at least one of paper, metal, foil, and a die cut material.

8. The system of claim 1 further comprising a printer apparatus said printing that includes said arrangement of cross rollers and said registration transport and said steering mechanism.

9. The system of claim 8 wherein said printer apparatus comprises an aqueous inkjet printer.

10. A system for mitigating print head dry out, comprising:

at least one processor; and a non-transitory computer-usable medium embodying computer program code, said computer-usable medium capable of communicating with said at least one processor, said computer program code comprising instructions executable by said at least one processor and configured for:

transporting at least one substrate for printing utilizing an arrangement of cross rollers and a registration transport; and driving said at least one substrate into opposing registration print edges of print heads on said registration transportation via a steering mechanism, such that said cross rollers only engage when said at least one substrate is being registered to an appropriate edge of said print heads, thereby allowing said print heads to be exercised prior to drying out.

11. The system of claim 10 wherein when said at least one substrate is out of at least one nip, said at least one nip disengages, thereby allowing at least one next sheet to be stirred on an opposing edge of said registration print heads.

12. The system of claim 10 wherein said opposing registration print heads comprise an inboard registration edge and an outboard registration edge.

13. The system of claim 10 wherein said arrangement of cross rollers comprises a first series of cross rollers deployed opposite a second series of cross rollers wherein at least some cross rollers among said first said series of cross rollers are disengaged and engaged during transport of said at least one substrate, and wherein at least some of cross rollers among said second series of cross rollers are disengaged and engaged during said transport of said sheet.

14. The system of claim 10 wherein said at least one substrate comprises at least one sheet.

15. The system of claim 10 wherein said at least one substrate comprises at least one of paper, metal, foil, and a die cut material.

16. The system of claim 10 further comprising a printer apparatus said printing that includes said arrangement of cross rollers and said registration transport and said steering mechanism.

17. The system of claim 16 wherein said printer apparatus comprises an aqueous inkjet printer.

18. A method for mitigating print head dry out, said method comprising:

automatically transporting at least one substrate for printing utilizing an arrangement of cross rollers and a registration transport; and automatically driving said at least one substrate into opposing registration print edges of print heads on said registration transportation via a steering mechanism, such that said cross rollers only engage when said at least one substrate is being registered to an appropriate edge of said print heads, thereby allowing said print heads to be exercised prior to drying out.

19. The method of claim 18 wherein when said at least one substrate is out of at least one nip, said at least one nip disengages, thereby allowing at least one next sheet to be stirred on an opposing edge of said registration print heads and wherein said opposing registration print heads comprise an inboard registration edge and an outboard registration edge.

20. The method of claim 18 wherein said arrangement of cross rollers comprises a first series of cross rollers deployed opposite a second series of cross rollers wherein at least some cross rollers among said first said series of cross rollers are disengaged and engaged during transport of said at least one substrate, and wherein at least some of cross rollers among said second series of cross rollers are disengaged and engaged during said transport of said sheet.

* * * * *